US006061943A

United States Patent [19]

Pepys

[11] Patent Number: 6,061,943

[45] Date of Patent: May 16, 2000

[54] PHOTO ALBUM FOR AN INFANT

[75] Inventor: Shirley D. Pepys, Balboa Island, Calif.

[73] Assignee: Noel Joanna, Inc., Compton, Calif.

[21] Appl. No.: 09/053,402

[22] Filed: Mar. 31, 1998

[51] Int. Cl.[7] ..... A47G 1/06; B42D 1/08

[52] U.S. Cl. ..... 40/771; 281/38; 434/428; 434/429

[58] Field of Search ..... 40/771; 281/29, 281/37, 51, 38; 434/81, 365, 428, 429; 150/138, 139, 147, 148

[56] References Cited

U.S. PATENT DOCUMENTS

| | | | |
|---|---|---|---|
| 2,718,911 | 9/1955 | Solomon | 150/147 |
| 2,725,913 | 12/1955 | Horwin | 40/649 X |
| 3,146,816 | 9/1964 | Osher | 150/148 |
| 4,165,890 | 8/1979 | Leff | 40/654.01 X |
| 4,194,655 | 3/1980 | Tillotson | 150/147 X |
| 4,259,799 | 4/1981 | Fulton, Jr. | 40/771 X |
| 4,267,655 | 5/1981 | Holson | 40/771 |
| 4,280,241 | 7/1981 | Pfaff | 281/29 X |
| 4,356,652 | 11/1982 | Schneider | 40/771 X |
| 5,219,437 | 6/1993 | Moor et al. | 281/29 |
| 5,431,207 | 7/1995 | Siegel | 150/139 |
| 5,431,449 | 7/1995 | Arimoto et al. . | |
| 5,676,482 | 10/1997 | Hawkins . | |

*Primary Examiner*—Terry Lee Melius
*Assistant Examiner*—Rodrigo J. Morales
*Attorney, Agent, or Firm*—Knobbe, Martens, Olson & Bear, LLP

[57] ABSTRACT

A flexible photo album has a flexible front cover, a flexible back cover and a plurality of pages disposed between the front and back covers. Each page has a front section and a back section coupled together by a fabric seam to form a pouch for holding photographs or other substantially flat objects. A portion of at least the front or back sections of the page is substantially transparent to allow the object within the pouch to be viewed through the front or back section.

28 Claims, 6 Drawing Sheets

PHOTO ALBUM FOR AN INFANT

BACKGROUND OF THE INVENTION

1. Field of the Invention

The present invention relates to photo albums, and in particular to a flexible photo album having a soft cover and a plurality of pages for holding photographs, pictures or other substantially flat objects.

2. Background of the Invention

Photo albums are an easy way to store several photos in a way so that they may be viewed by simply opening the album and turning the pages. While persons of all ages may enjoy looking at photographs or pictures, prior albums are difficult for infants or small children to use.

Prior albums generally have a hard cover to protect the pages of the album containing pictures. The pages themselves often have hard surfaces as well to provide support for each page. The hard materials from which prior albums are constructed, however, contribute to the overall weight and bulkiness of the album. Prior albums are thus typically very difficult for infants and small children to grasp or hold. In addition, due to the type of materials from which such albums are constructed, the albums themselves are hard and inflexible. A baby can easily injure himself or herself against such a hard object as these albums.

The pages of photo albums are often thin with sharp edges. In addition, the edges of the page usually meet to form a sharp edge, such as a 90° angle. Both sharp edges and sharp corners can cause injury to an infant, especially since an infant is likely to place the album in its mouth.

In addition, infants and children can easily damage the album pages or photos on the page in photo albums. For example, if the photo is affixed or attached to the surface of the page, the photo remains exposed and susceptible to damage from water, dirt, saliva and the like. Furthermore, the pages of photo albums are not generally sturdy enough to withstand repeated use by an infant who, rather than carefully turning each page, is likely to tug, pull, bang, drool, etc. on each page. Thus, these pages can be easily torn, ripped or otherwise damaged.

SUMMARY OF THE INVENTION

The present invention involves a photo album particularly suited for use by infants and small children. The album provides a soft, flexible cover with flexible pages for holding photos. The album cover includes an outer fabric layer, an inner fabric layer and a soft material disposed between the outer and inner layers. This soft material contributes to the softness and flexibility of the album as well as provides a thickness to the cover. Because of an infant's limited motor skills, the thickness of the album makes it easier for an infant to grasp and hold onto the album.

The pages of the album are adapted to hold a photograph or other substantially flat object. The pages are also flexible and are made of a material having a sufficient thickness and durability so that the page can generally be bent or manipulated without losing its original shape. Further, the edges of the page as well as the corners of the page which are exposed to the user are rounded to reduce the chance of injury.

In addition, a portion of the outer surface of the album cover includes a design to visually stimulate infants. For instance, the cover may comprise a picture, design or pattern. Since infants have an heightened response to certain colors during their early development, certain color combinations can be utilized to visually stimulate the baby, depending on the age and development level of the child.

In accordance with one aspect of the present invention, a photo album includes a soft, flexible front cover, a soft, flexible back cover, and at least one page between the front cover and the back cover. Each page of the album has a first side and a second side, and is adapted to hold a substantially flat object between the first and second sides. The first and second sides of the page are coupled together by a seam of soft material. The seam extends generally around the edges of the page, except at an opening of a sufficient size to allow the object to be inserted between the first and second sides of the page. At least one of the first or second sides of the page comprises substantially transparent material to allow the object to be viewed through the page while the object is positioned between the first and second sides of the page.

In accordance with another aspect of the present invention, a flexible photo album has a flexible cover having a front cover and a back cover. At least one page is situated between the front cover and the back cover. Each page includes a pouch which has a first layer and a second layer. The pouch is adapted to hold a substantially flat object between the first and second layers. At least a portion of the first layer or the second layer of the pouch is made of substantially transparent material to allow the object to be viewed through it while the object is in the pouch. In addition, the entire first or second layer of the pouch can be made from substantially transparent material. Furthermore, both the first and second layers of the pouch can be made from a substantially transparent material to allow the object to be viewed from both sides of the page. This provides more space in the album for holding photos without having to add additional pages to the album.

BRIEF DESCRIPTION OF THE DRAWINGS

These and other features of the invention will now be described with reference to the drawings of one embodiment of the present flexible photo album, which are intended to illustrate, but not to limit the invention. The drawings contain the following figures.

DETAILED DESCRIPTION OF THE PREFERRED EMBODIMENT

Figure 1:
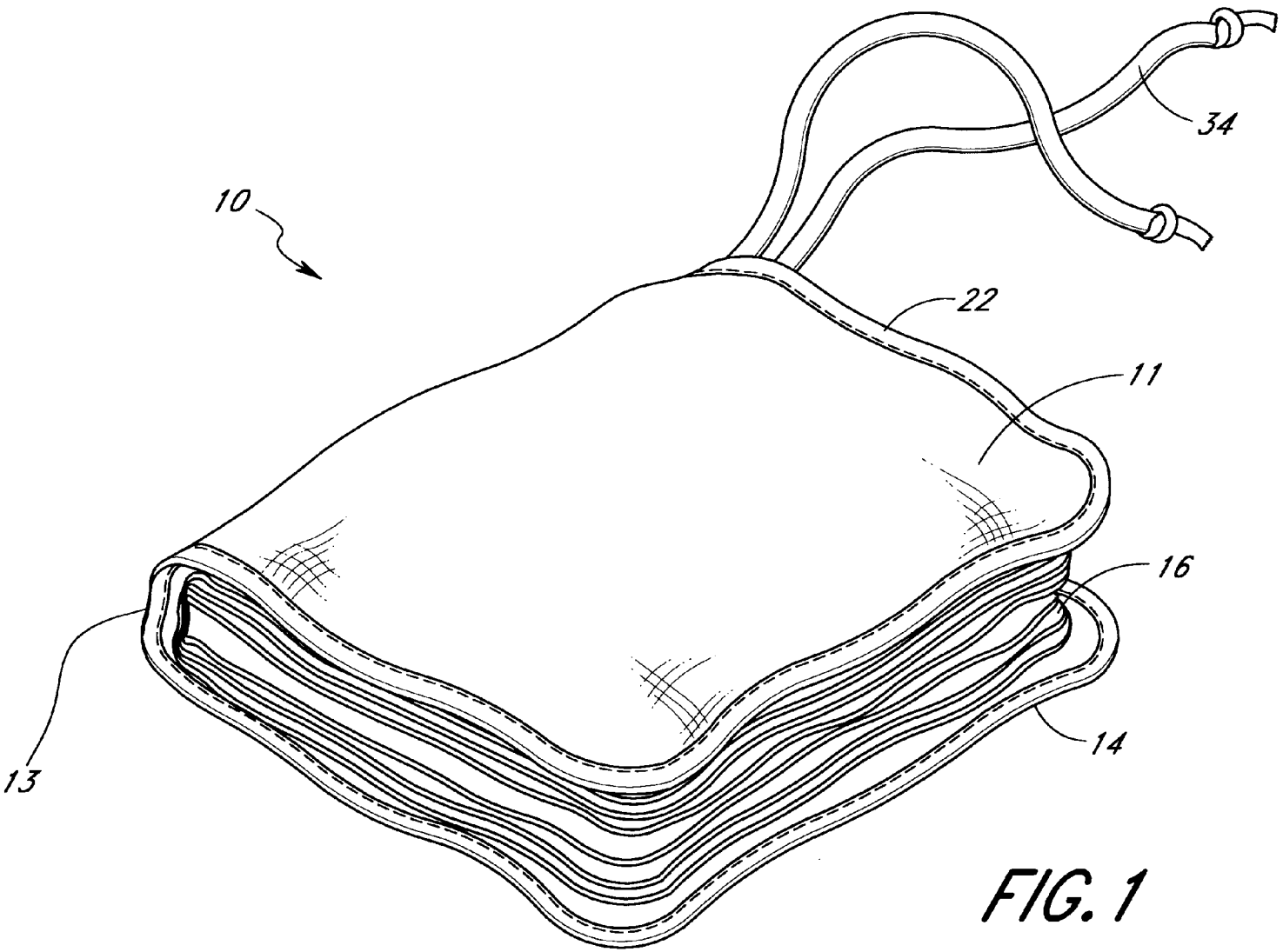
FIG. 1 is a perspective view of photo album configured in accordance with an embodiment of the present invention in a closed position.
Figure 2:
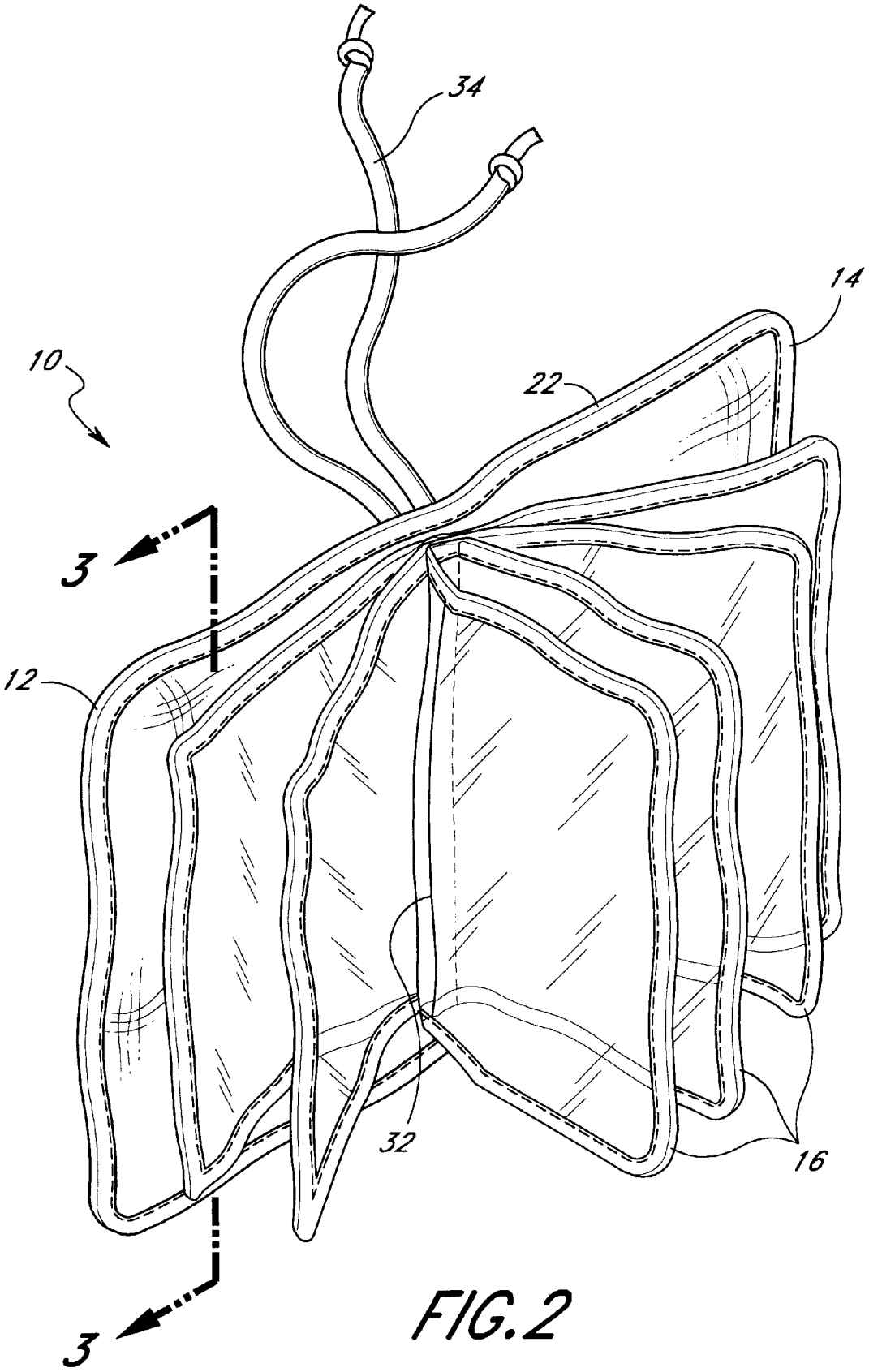
FIG. 2 is a perspective view of the photo album of FIG. 1 in a partially open position.

FIGS. 1 and 2 illustrate a flexible photo album 10 configured in accordance with the present invention. The photo album 10 comprises cover 11 which includes a front cover 12 and a back cover 14 and a plurality of pages 16 between the front and back covers 12, 14. The front and back covers 12, 14 are made of soft, flexible material, such as fabric made of cotton, polyester or a cotton/polyester blend. The fabric cover makes the album 10 soft and flexible. Because of the flexibility and softness of the album 10, infants can grasp the album cover 11 and form a clenched fist, thereby bending or twisting the album cover, without tearing or breaking the structure of the album cover. For instance, infants or other persons with limited fine motor skills generally grab objects with a fist, rather than a coordinated movement of the thumb and forefinger. Such action by an infant will not cause damage to the album since the flexible cover will not retain this twisted shape after the infant has let go of the album 10.

Figure 3:
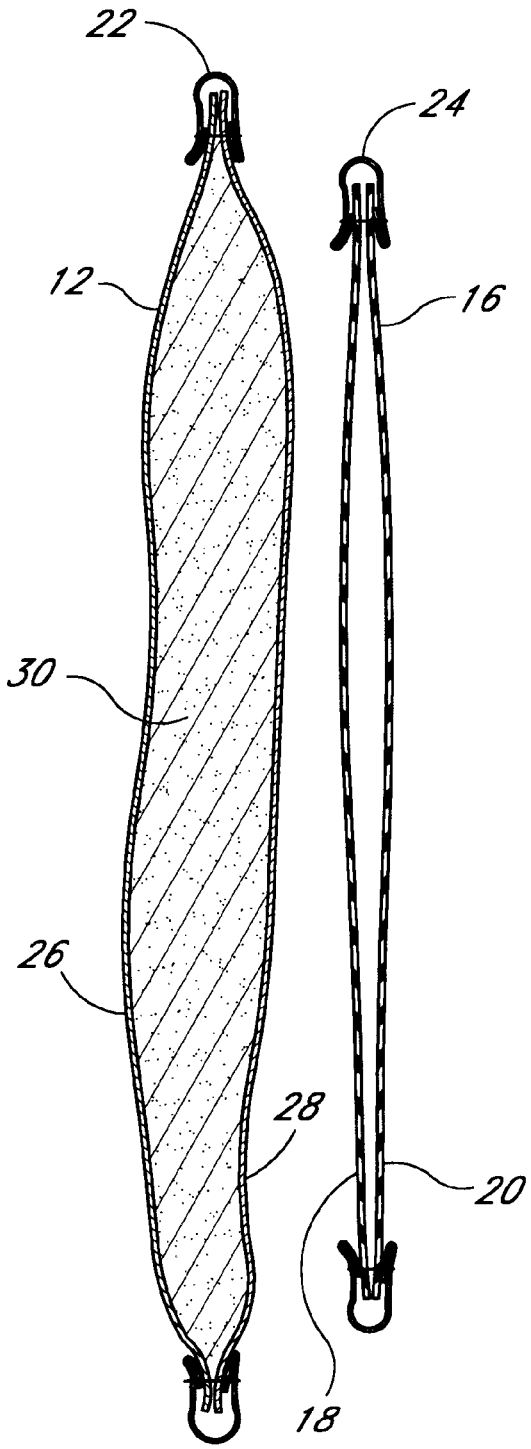
FIG. 3 is a cross-sectional view of the front cover and first page of the photo album of FIG. 2 taken along line 3—3 of FIG. 2.

The surface of the cover 11 is cleanable so that dirt, food, saliva, etc. can be wiped from the cover 11. As shown in FIG. 3, the cover has an outer surface 26 and an inner surface 28. In a preferred embodiment, both the outer and inner surfaces 26, 28 of the cover 11 are comprised of a fabric which restricts absorption of liquid or dirt within the fabric. A water based ink can be used on the fabric during a screen print process, as is known in the art. Other methods may also be used to treat the fabric, such as, for example, by using a water repellant solution. In addition, the cover 11 may comprise a water resistant fabric or embroidering so that it is not necessary to treat the fabric.

Figure 6:
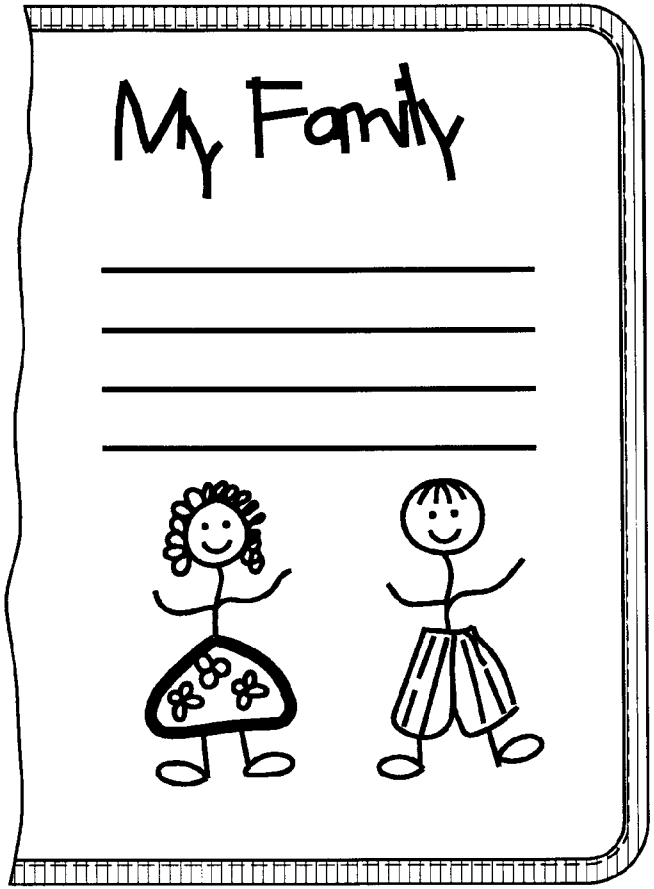
FIG. 6 is a top view of a portion of the inside back cover of a photo album in accordance with the present invention.

The inner surface 28 of the cover is adapted to be written upon, such as with an ink pen. For instance, in one embodiment, the inner cover 28 is comprised of a cotton/polyester blend which absorbs ink. Among other things, this enables the album 10 to be personalized with the name of the owner or list the names of the owner's family (FIG. 6). As illustrated in FIG. 6, in a preferred embodiment, the inner surface of the cover is comprised of a white or light color which provides a light background upon which the user can write. In the illustrated embodiment, the name of each family member can be written on the lines provided on the inner surface of the cover.

While the album 10 in FIGS. 1 and 2 is shown without any pattern or design on its cover 11, in a preferred embodiment, the album cover 11 has a design, such as that described below and shown in FIG. 5.

The front and back covers 12, 14 are joined at the spine 13 of the album. In the illustrated embodiment, the front cover 12, back cover 14 and spine 13 are unitary, and the spine 13 is covered by the fabric of the cover 11. Further, the spine 13 is formed by the stitching attaching the pages 16 of the album to the cover 11. Although it may be somewhat less flexible than the front and back covers 12, 14, the spine 13 is also flexible and bendable.

In the illustrated embodiment, the album 10 has a generally rectangular shape. In other embodiments, however, the album can be shaped differently, such as, but not limited to, triangular, circular or an irregular shape.

In the illustrated embodiment, the comers of the album cover 11, including both the front and back covers 12, 14, are rounded. The rounded corners reduce the chance of injury to an infant since there are no sharp corners which can easily cut or poke the infant. In addition, since infants and small children often place objects in their mouth, particularly while teething, the absence of sharp corners further reduces the risk of injury to the child's mouth.

As best shown in FIG. 3, in the illustrated embodiment, the front cover 12 has a first or front side 26 and a second or back side 28. The first and second sides 26, 28 are generally parallel to one another and held together by a fabric seam 22. The seam 22 is stitched onto both the front side 26 and the back side 28 of the front cover 12. In the illustrated embodiment, the seam 22 extends around the sides of the cover 12 except at the spine 13 of the album. For instance, the seam 22 extends along the top side, the right side, and the bottom side of the front cover 12 in the illustrated embodiment. In another embodiment, however, the seam 22 may extend around the entire perimeter of the cover 12, including the spine 13. The soft, fabric seam 22 further reduces the chance of injury to an infant or child, particularly if the album is thrown or is placed in the child's mouth. The seam 22 also provides a slight thickness to the edge of the page so that the edges are not sharp.

In the illustrated embodiment, there is a soft, filler material 30, such as batting, between the first and second sections 26, 28. This filler material 30 provides some thickness to the cover 12, thereby making the cover easier to grasp for an infant, small child or one with limited motor skills. In addition, the filler material 30 contributes to the softness of the cover, which further reduces the chance of injury to an infant who is likely to throw the album or hold onto it while flailing around its arms.

The back cover 14 has a similar configuration to the front cover 12. The terms front and back are used for ease of description and should not be construed as a limitation.

A plurality of flexible pages 16 are pivotally disposed between the front and back covers 12, 14, and attached to the spine 13 of the album. While in the illustrated embodiment, the pages 16 are sewn to the spine 13, the pages may be coupled to the spine 13 in other ways, such as with glue. Like the corners of the front and back covers 12, 14, the corners of the pages 16 are also rounded. The pages 16 have the same shape and are about the same size or slightly smaller than the album cover. In the illustrated embodiment, the pages 16 are rectangular in shape and about 5 inches by 7 inches in size.

The page 16 shown in FIG. 3 and described herein is representative of the other pages 16 of the album 10. The album 10 may, however, contain additional pages which differ from the described page 16, including, for example, a page which is not configured to hold a photograph.

The page 16 of the album is configured to hold a picture, photograph, or other substantially flat object. The page 16 has a first or front layer 18 and a second or back layer 20 (FIG. 3). The planes of the first and second layers 18, 20 are generally parallel to one another and are in close proximity.

A fabric seam 24, which is similar to the seam 22 of the cover 11, connects the first and second layers 18, 20 of the page 16 to one another. This seam 24 extends around the sides of the page 16, except at the side of the pages attached to the spine 13 of the album. Each page 16 forms a pouch with an opening 32 (FIG. 2) sufficiently large to permit insertion of an object between the front and back layers 18, 20. The fabric seam 24 provides a slight thickness to the edge of the page 16 and is soft to reduce injury, such as small cuts, when grasping the page. The seam 24 additionally provides a soft structure to the edges of the page and contributes to the sturdiness of the page 16. Thus, the seam 24 makes it difficult to tear or otherwise damage the page 16 or the photo within it.

In the illustrated embodiment, both the front layer 18 and the back layer 20 of the page 16 are substantially transparent. This allows an object (not shown) which is placed between front 18 and back layers 20 to be viewed through the page 16. In other embodiments, a page 16 may have only a front layer or a back layer which is transparent. For instance, in one embodiment, where only the front layer of the page 16 is transparent, objects inserted through the opening in the page 16 will only be visible when viewed from the front side. It is further possible for only a portion of the front layer or the back layer to be substantially transparent.

The pages 16 are substantially waterproof to protect the object within the pouch of the page from water, juice, saliva and the like. For instance, the front and back sides 18, 20 of the page can be made from a clear vinyl or plastic material. Since babies tend to place objects in their mouth and/or drool heavily, a photograph placed within a pouch made from vinyl, plastic or similar material of sufficient thickness and durability will be protected from such elements. In addition, the waterproof page 16 can be easily cleaned with a cloth.

Figure 5:
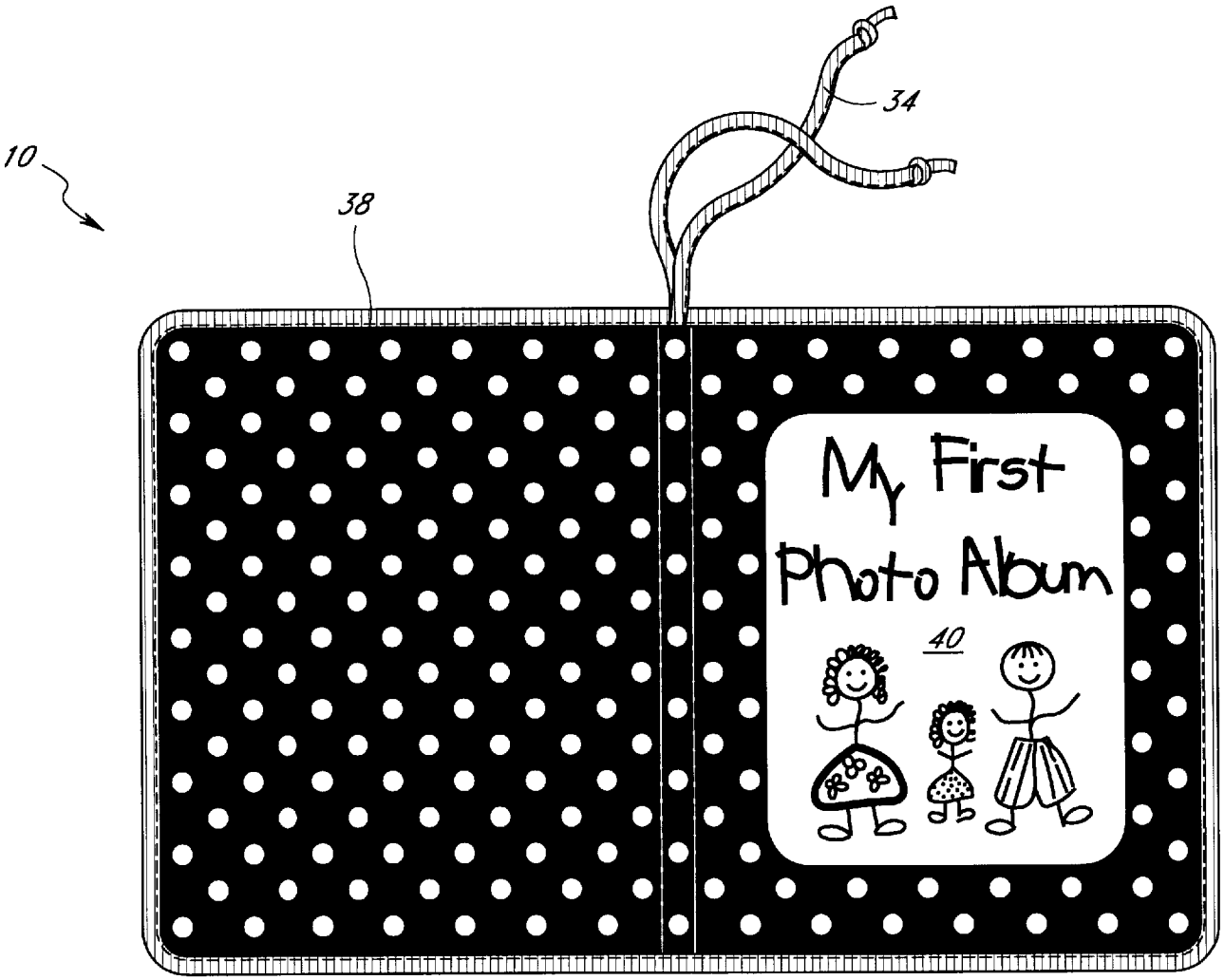
FIG. 5 is a top view of the cover of a photo album of one embodiment of the present invention in an open position.

FIG. 5 illustrates a cover 11 of an album 10 in an open position so that the cover is flat. In a preferred embodiment, the album cover 11 has a design such as a pattern 38. In the illustrated embodiment, the design on the cover 11 is a pattern of shapes 38. In particular, the album cover 11 has a black background with a plurality of small white circles. In the illustrated embodiment, the pattern 38 is comprised of black and white colors only. Other shapes, such as but not limited to, squares, triangles and the like may also be used in a pattern on the cover. Further, alternative designs, such as drawings or pictures, instead of or in addition to patterns, may also be shown on the cover 11. The design 38 of the cover can be imprinted on the cover by silk screens, dyes or the like.

It is believed that at an early age infants primarily see objects in black and white. In addition, infants are attracted to and often visually stimulated by various shapes, including patterns of shapes. Thus, an album cover, such as the one shown in FIG. 5, having both a pattern of shapes and comprised primarily of black and white colors stimulates the visual development of the infant.

Another color that infants can see at an early stage in their visual development is the color red. The seams 22, 24 of the covers 12, 14 and pages 16 in the illustrated embodiment are, thus, preferably red. While this color combination is not necessary for a flexible photo album, the combination of black, white and red colors described above visually stimulates an infant and, thus, are desirable, in photo albums designed for young children. In other embodiments, the combinations of blue and white; red and yellow; blue, white and red; and other color combinations may be implemented.

In the illustrated embodiment, the front cover 12 has a rectangular-shaped section in which the pattern 38 is not present 40. This space 40 can be used to customize the album 10 for a child by writing their name on the front cover, or it may contain a design imprinted by a manufacturer of the album 10, or the like (FIG. 5). In other embodiments, the design 38 may cover the entire outer surface of the cover 11, thereby eliminating the rectangular space 40 shown in FIG. 5.

Figure 4:
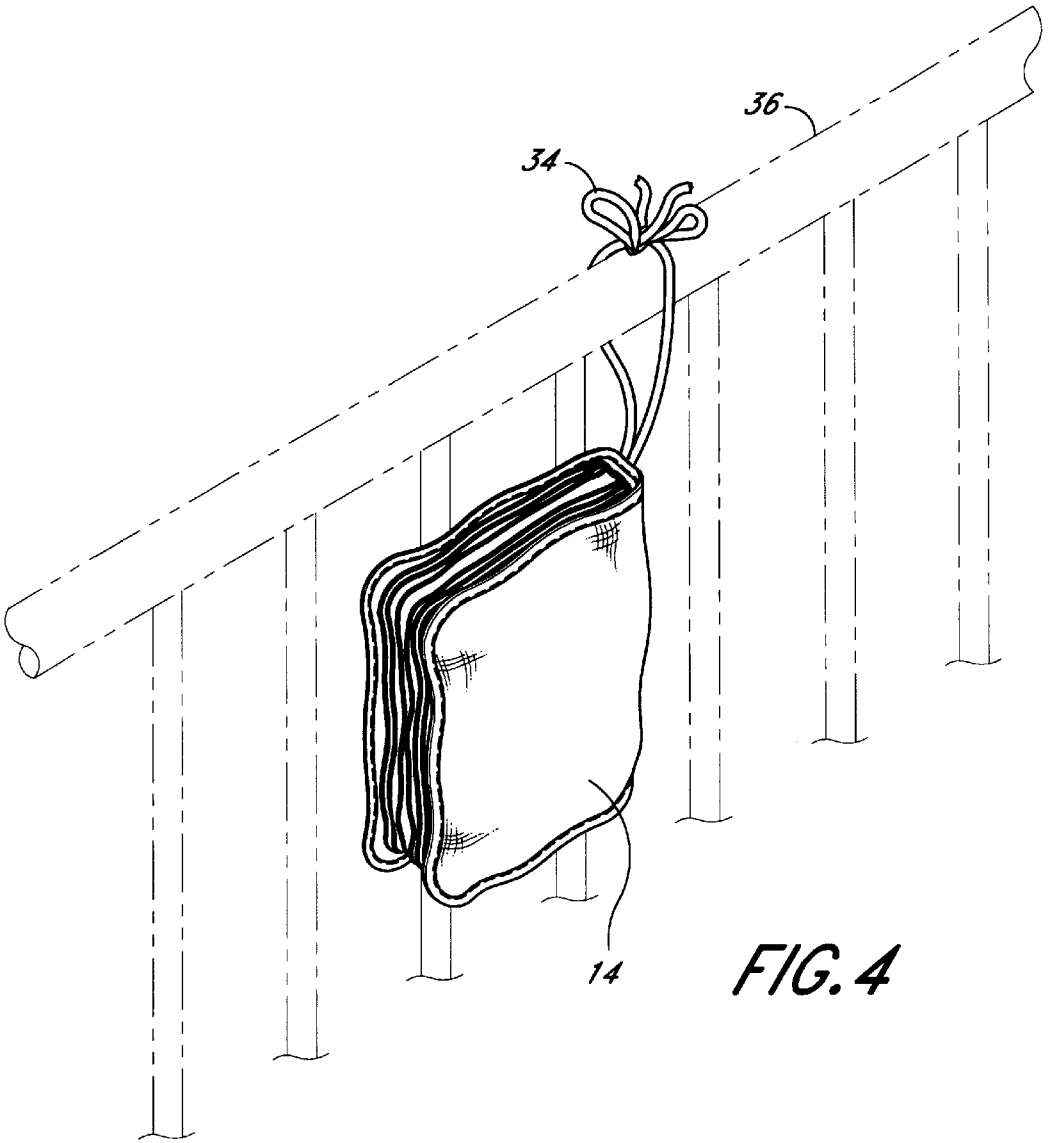
FIG. 4 is a perspective view of the photo album of FIG. 1 in a closed position attached to a fixture.

The photo album 10 can also include one or more tie members or ribbons 34 extending from its cover, and in particular the spine 13. The tie member 34 can be tied in a knot or bow around a fixture 36 (FIG. 4). While in the illustrated embodiment, the album 10 has two tie members 34, one tie member can be sufficient to attach the photo album 10 to a fixture 36, such as an infant enclosure, crib, playpen, changing table, stroller, infant carrier device, and the like. An infant can thus view the photographs within the album, thereby occupying the infant's attention, while its diaper is being changed.

One of the advantages of the design of the flexible photo album is that it can be easily and safely used by infants, small children or other persons with limited motor skills. The thickness of the cover makes it easy to grasp, while the soft fabric edges and rounded corners of both the cover and the pages within the album reduce the risk of injury to the user.

The pouches of each page enable the album to be customized so that the infant can enjoy photographs of themselves or family members. Because the first and second sides of the pouch are in close proximity to one another, the photos are tightly held within the pouch and do not easily fall out. In addition, while it is relatively easy for an adult to insert the photos into, or remove the photos from, the pouch, it is difficult for an infant to slide the photo through the opening to remove it from the pouch. The substantially transparent material of the page allows for viewing of the photograph through the page.

Another advantage of the photo album is that both the cover and pages within it are flexible. The fabric seams provide a flexible support structure for the page. Therefore, the pages can be bent or folded without breaking or tearing. Further, the album is lightweight and easy for an infant to grasp and hold.

The substantially waterproof nature of the pages is another advantage of the design of the one embodiment of the photo album. By placing the document within a water-resistant or waterproof pouch, the document or photo is protected from damage or dirt, saliva, etc. In prior albums, photographs or other objects are typically attached to the surface of the page. Such a configuration, however, exposes the photo to considerable damage, especially when given to a baby, who is likely to place the page in its mouth. The album is durable and only minimally susceptible to damage, even in view of repeated use by an infant.

Although the foregoing invention has been described in terms of certain preferred embodiments, other embodiments will become apparent to those of ordinary skill in the art in view of the disclosure herein. Furthermore, the skilled artisan will recognize the interchangeability of various features of one embodiment to another embodiment. Accordingly, the present invention is not intended to be limited by the recitation of preferred embodiments, but is intended to be defined solely by reference to the appended claims.

What is claimed is:

1. An album for an infant comprising:

a soft, flexible cover having a front cover and a back cover; and at least one page pivotally disposed between the front cover and the back cover, the page having a generally rectangular shape, the page comprising a first side and a second side and adapted to hold a substantially flat object between the first side and the second side, the first and second sides being coupled together by a seam of soft material, the seam extending generally around three edges of the page, the seam comprising a sleeve attached to the first side and to the second side of the page to form a soft structure around the three edges of the page, the page having an opening of a sufficient size to allow the object to be inserted between the first and second sides of the page, at least one of the first and second sides comprising a substantially transparent material to allow the object to be viewed through the page while the object is positioned between the first and second sides of the page.

2. The album of claim 1, wherein the cover comprises a fabric material.

3. The album of claim 2, wherein the front cover and back cover each comprise a first fabric layer, a second fabric layer and a soft, filler material disposed between the first and second layers.

4. The album of claim 1, wherein the cover has rounded corners.

5. The album of claim 1, wherein the pages has rounded corners.

6. The album of claim 1, wherein at least a portion of both the front and back sides of the page are comprised of a substantially transparent material to allow the object to be viewed through both the first and second sides.

7. The album of claim 1, wherein the first and second sides of the page are comprised of a substantially waterproof material to protect the object from water, saliva and the like.

8. The album of claim 1 additionally comprising a tie member extending from the cover.

9. The album of claim 1, wherein the cover comprises a pattern of shapes.

10. The album of claim 1, wherein the cover comprises a combination of colors which visually stimulate an infant.

11. A photo album comprising:

a flexible cover having a front cover and a back cover; and at least one page situated between the front cover and the back cover, the page having two rounded corners, the page comprising a pouch having a first layer and a second layer, the pouch being adapted to hold a substantially flat object between the first and second layers, at least a portion of one of the first and second layers of the pouch comprising a substantially transparent material to allow the object to be viewed through the substantially transparent portion while the object is in the pouch each of the corners being surrounded by a sleeve attached to the first layer and to the second layer to form a soft structure around the corners.

12. The photo album of claim 11, wherein the entire first layer of the pouch is comprised of a substantially transparent material.

13. The photo album of claim 12, wherein at least a portion of both the first layer and the second layer of the pouch are comprised of a substantially transparent material to allow the object to be viewed through both the first and second layers.

14. The photo album of claim 11, wherein the pouch is comprised of a substantially waterproof material to protect the object from water, saliva and the like.

15. The photo album of claim 11, wherein the first layer and the second layer of the pouch are coupled together by a fabric seam.

16. The photo album of claim 11 additionally comprising a tie member extending from the cover.

17. The photo album of claim 11, wherein the cover includes means for stimulating a baby.

18. An album for infants comprising:

a soft cover having a front cover section and a back cover section, the cover having an outer surface and an inner surface;

a plurality of pages each pivotally attached to the cover and positioned between the front and back cover sections, the pages being adapted to hold a photograph;

a fabric sleeve extending generally around three edges of each page; and means for visually stimulating an infant on at least a portion of the outer surface of the cover of the album.

19. The album of claim 18, wherein the means for visually stimulating an infant comprises a pattern of shapes.

20. The album of claim 18, wherein the means for stimulating an infant includes a combination of colors.

21. The album of claim 20, wherein the means for stimulating an infant comprises the combination of black and white only.

22. The album of claim 20, wherein the means for stimulating an infant comprises a combination of black, white and red colors.

23. A photo album for infants comprising:

a flexible cover comprising an outer fabric layer, an inner fabric layer, and a soft material between the outer fabric layer and the inner fabric layer;

a fabric seam attached to the outer fabric layer and to the inner fabric layer along an edge of the flexible cover; and a plurality of flexible pages each pivotally attached to the cover, at least one of the plurality of pages having a first layer, a second layer, the first layer coupled to the second layer by a fabric seam, the page being adapted to hold a photograph between the first and second layers of the page, at least a portion of the first layer being substantially transparent to allow the photograph to be viewed while between the first and second layer.

24. The photo album of claim 23, additionally comprising a tie member extending from the cover.

25. The album of claim 1, wherein a plurality of pages are pivotally disposed between the front cover and the back cover.

26. The album of claim 1, wherein the seam is stitched to the first side and to the second side of the page.

27. The photo album of claim 11, wherein the entire second layer of the pouch is comprised of a substantially transparent material.

28. The photo album of claim 11, wherein a plurality of pages are situated between the front cover and the back cover.

* * * * *

UNITED STATES PATENT AND TRADEMARK OFFICE

CERTIFICATE OF CORRECTION

PATENT NO. : 6,061,943
DATED : May 16, 2000
INVENTOR(S) : Shirley D. Pepys

It is certified that error appears in the above-identified patent and that said Letters Patent is hereby corrected as shown below:

Page 5,
Line 10, replace "the comers" with -- the covers --.

Claim 5,
Replace "the pages" with -- the page --.

Signed and Sealed this

Twenty-fifth Day of December, 2001

*Attest:*

*Attesting Officer*

JAMES E. ROGAN
*Director of the United States Patent and Trademark Office*